US006687939B1

(12) United States Patent
Koester

(10) Patent No.: US 6,687,939 B1
(45) Date of Patent: Feb. 10, 2004

(54) BUCKET SWEEPER

(75) Inventor: Jay Koester, Manchester, IA (US)

(73) Assignee: Attachment Technologies, Inc., Delhi, IA (US)

( * ) Notice: Subject to any disclaimer, the term of this patent is extended or adjusted under 35 U.S.C. 154(b) by 276 days.

(21) Appl. No.: 09/681,756

(22) Filed: May 31, 2001

(51) Int. Cl.[7] ..... E01H 1/04
(52) U.S. Cl. ..... 15/83; 414/501
(58) Field of Search ..... 15/83, 52.1, 82, 15/79.1, 84; 414/501

(56) References Cited

U.S. PATENT DOCUMENTS 2,697,846 A * 12/1954 Wilcox et al. ..... 15/83
3,354,489 A * 11/1967 Ehrich ..... 15/83
4,895,476 A * 1/1990 Vangaever ..... 404/108
5,369,832 A 12/1994 Hagger
5,893,189 A 4/1999 D'Costa
5,991,953 A 11/1999 Durenberger et al.
6,154,911 A 12/2000 Vanderlinden

* cited by examiner

*Primary Examiner*—Robert J. Warden, Sr.
*Assistant Examiner*—S Balsis
(74) *Attorney, Agent, or Firm*—James C. Nemmers

(57) ABSTRACT

A bucket sweeper combination unit that is used in connection with a skid loader or skid steer which has universal mounts and remote hydraulics that power the unit. The sweeper is mounted to the lift arms of the loader ahead of the bucket. Chains are attached to the rear of the sweeper and the lift arms of the loader, and the bucket is pivotally attached to the mounting arms so that it can be pivoted when it is desired to dump the spoil material. A spoil guard is located on the bucket side of the rotating brush of the sweeper unit so that as the material is picked up by the brush, it will be deflected by the spoil guard directly into the bucket and retained in the bucket by the downwardly extending portion of the spoil guard. Preferably, the spoil guard is made adjustable so that its position can be moved closer to the rotating brush as the bristles wear shorter.

9 Claims, 3 Drawing Sheets

BUCKET SWEEPER

BACKGROUND OF INVENTION

There are known and commercially used what are called sweeping machines for sweeping up debris into a hopper or bucket which when full can be dumped for transport to an appropriate place. These sweeping machines include bucket sweepers which have a sweeper and a bucket that are combined with a front end loader, a skid steer, skid loader or similar prime mover. Some of the known sweeper units provide for attaching the sweeper unit to a somewhat conventional bucket so that the unit can be used a sweeper with the bucket or the sweeper can be attached and the bucket used alone. An example of such a unit is shown in U.S. Pat. No. 5,369,832. Another example of prior art units using a combined sweeper and bucket or hopper is shown in U.S. Pat. No. 6,154,911. Other known units of this type utilize an integrated unit in which the sweeper unit is enclosed within a housing and combined with a hopper or bucket mounted so as to pivot relative to the sweeper unit when it is desired to dump the contents of the bucket.

One of the problems of prior art units of the integrated bucket-sweeper type is that the buckets will hold only a portion of their full, rated capacity, thus requiring frequent dumping of the buckets and resulting in an inefficient use of the operator's time. Also, with many units, when the gathered material includes dust or other fines, these fines are frequently drawn back through the rotating sweeper brushes and thus generate an excessive amount of dust.

There is therefore a need for an improved integrated bucket sweeper unit in which the effective volume capacity of the bucket can be substantially increased to near the rated capacity and a unit which will also minimize dust generation during operation.

The bucket sweeper combination unit of the invention is used in connection with a skid loader or skid steer which has universal mounts and remote hydraulics that power the unit. The sweeper is mounted to the lift arms of the loader ahead of the bucket. Chains are attached to the rear of the sweeper and the lift arms of the loader, and the bucket is pivotally attached to the mounting arms so that it can be pivoted when it is desired to dump the spoil material. A spoil guard is located on the bucket side of the rotating brush of the sweeper unit so that as the material is picked up by the brush, it will be deflected by the spoil guard directly into the bucket and retained in the bucket by the downwardly extending portion of the spoil guard. Preferably, the spoil guard is made adjustable so that its position can be moved closer to the rotating brush as the bristles wear shorter.

DETAILED DESCRIPTION

Figure 1:
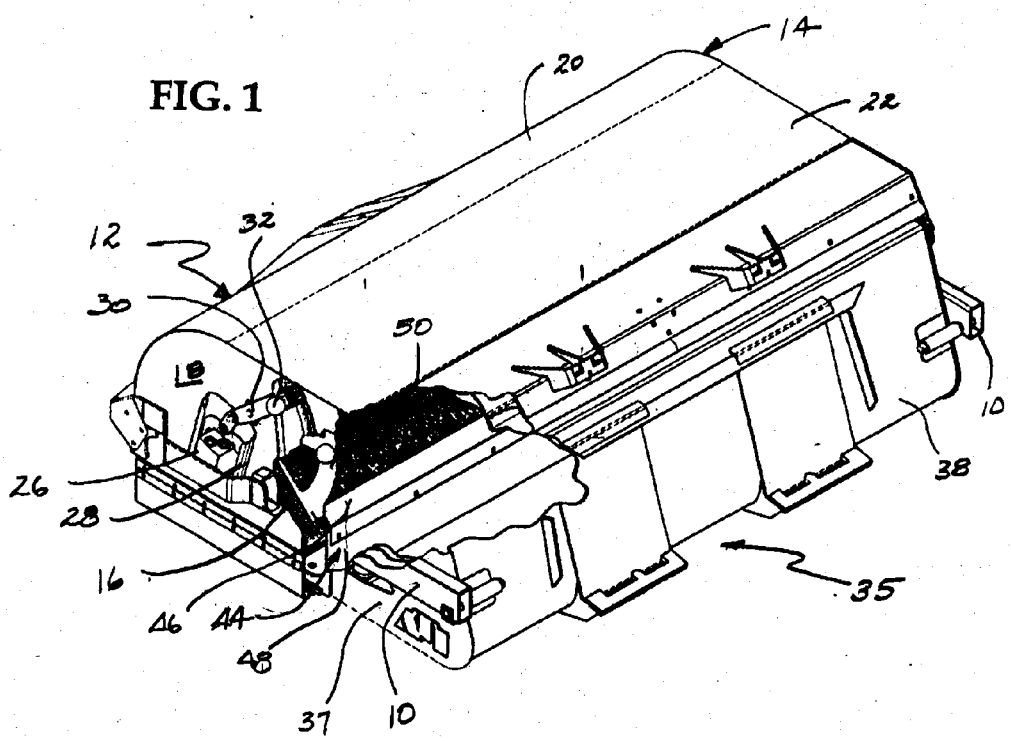
FIG. 1 is a perspective view of the bucket sweeper unit with the bucket closed and the unit in position to gather material.

Referring now to the drawings, there is shown a bucket sweeper unit constructed according to the principles of the invention, which unit is designed to be attached to a skid loader or skid steer with universal mounts and remote hydraulics as is well known to those skilled in the art. Such prime movers provide the hydraulic system necessary to carry out the operation of the unit as described hereinafter. Skid loaders, their universal mounts and remote hydraulics are well known to those skilled in the art and form no part of the invention and therefore are not further described or shown herein.

The bucket sweeper unit of the invention has supporting beams 10 extending generally horizontally and outwardly from the front of a conventional skid loader or other prime mover. The support beams 10 are suitably attached to the skid loader and are laterally spaced apart so as to extend alongside of the housing 14 that encloses the rotating brush 16 of the sweeper unit which is indicated generally by the reference numeral 12. The housing 14 has side walls 18, a curved front wall 20 and a top wall 22.

Figure 3:
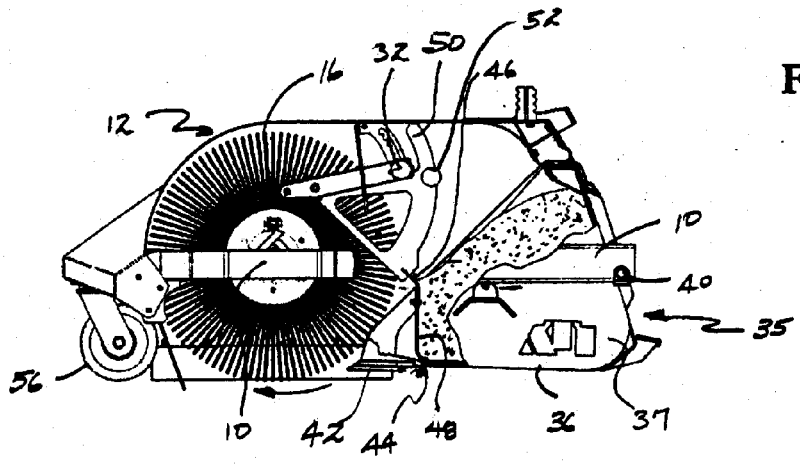
FIG. 3 is a side elevational view of the bucket sweeper unit of FIG. 2 with a portion of the housing cut away.
Figure 4:
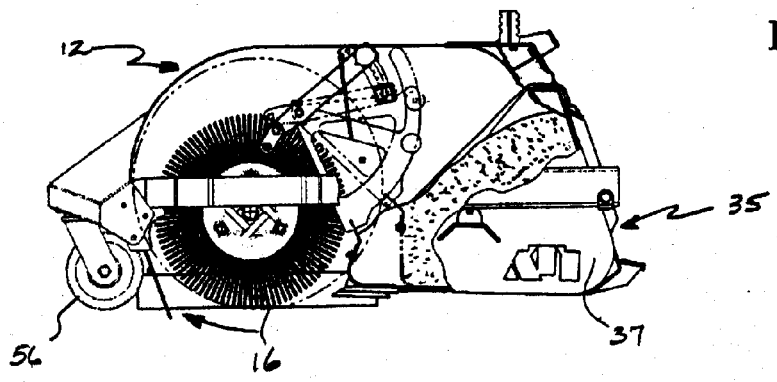
FIG. 4 is a side elevational view similar to FIG. 3 and illustrates the adjustability feature of the unit.

The rotating brush 16 is driven about an axle 24 by a hydraulic motor (not shown) with the axle being supported in bearing blocks 26 that are adjustably moveable in guides 28 so that the position of the rotating brush 16 relative to the ground surface can be adjusted as the bristles of the brush 16 wear. Adjustment of the position of the rotating brush 16 is accomplished by a linkage mechanism 30 that is moved by an operating handle 32 that is locked in place in a selected one of the positions that are provided by the detent slots 34. FIG. 3 illustrates the brush 16 in its up most position while FIG. 4 shows brush 16 in the lowest position.

Figure 7:
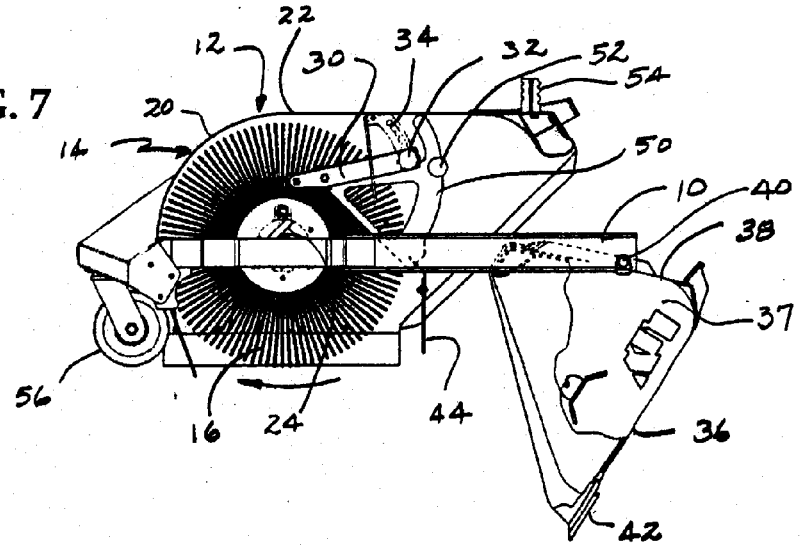
FIG. 7 is a side elevational view of the bucket sweeper unit showing the bucket in its dumping position.
Figure 2:
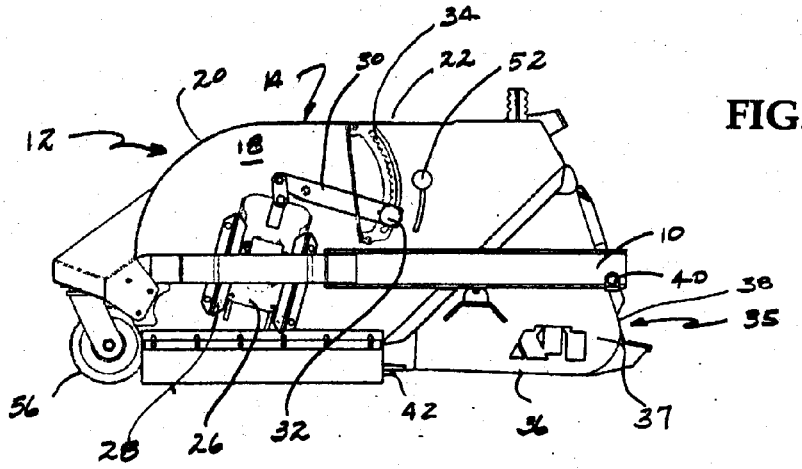
FIG. 2 is a side elevational view of the bucket sweeper unit.
Figure 6:
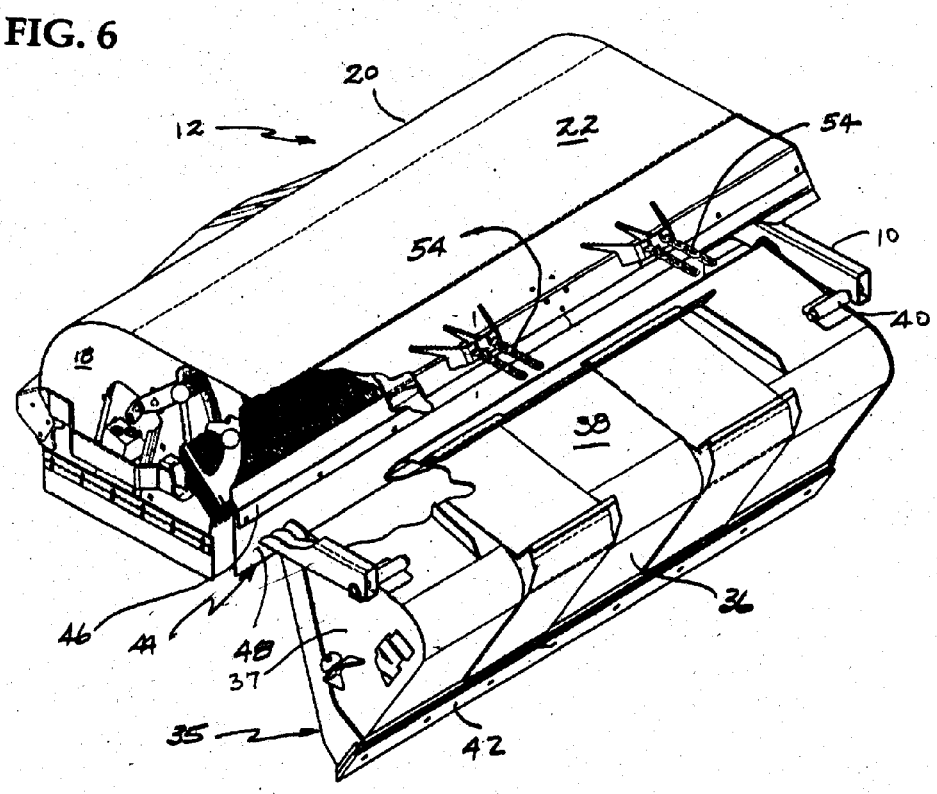
FIG. 6 is a perspective view of the bucket sweeper unit showing the bucket rolled out for dumping the spoil contained in it.
Figure 5:
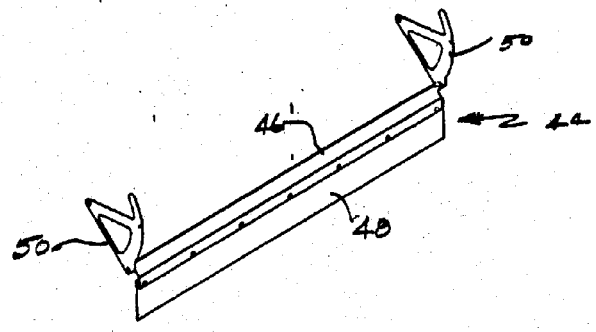
FIG. 5 is a perspective view of the spoil guard located between the sweeper and the bucket.

The hopper or bucket component 35 of the combination unit of the invention has a bottom wall 36, side walls 37 and a back wall 38 extending generally upwardly between the side walls 37. The walls 36, 37 and 38 define an open front that receives material directed into the bucket 35 by the rotating brush 16 of the sweeper unit 12. At the front edge of the bottom wall 36 there is provided a cutting edge 42. The bucket 35 is pivotally mounted on the support beams 10 by pivot pins 40. Thus, the bucket 35 can be rotated independently of the sweeper unit 12 from a closed position shown in FIGS. 1–4, in which the bottom wall 36 of the bucket 35 is positioned near the surface of the ground, to an open or dumping position shown in FIGS. 6 and 7.

When the rotating brush 16 is rotated in the clockwise direction as shown in the drawings, the debris picked up from the ground will be moved upwardly by the brush 16 against the curved wall 20 and carried over the top of the rotating brush 16 and then deposited into the bucket 35. With known conventional bucket sweepers, because the bucket 35 has an open front, when the bucket becomes filled to approximately one-third of its rated capacity, the debris will spill out over the cutting edge 42 along the front of the bottom wall 36 of the bucket 35. Any attempts to continue to gather additional material will thus be ineffective, and the operator will have to dump the material in the bucket 35 before proceeding with further cleaning. When the bucket 35 reaches this effective capacity of less than one-third of its rated capacity, further attempts at cleaning are futile because the material will merely be carried back out of the bucket 35 onto the ground. This will also create excessive dust if fines are being swept.

To increase the bucket capacity up to its design amount or rated capacity, there is mounted between the rotating brush 16 and the bucket 35 a downwardly extending spoil guard 44. The spoil guard 44 extends the full width of the rotating brush 16 and is attached to the side walls 18 of the housing 14 of the sweeper unit 12. Forming a part of and extending along the top of the spoil guard 44 is a deflecting plate 46 which will deflect material picked up by the brush 16 so that the material will be directed into the back of the bucket 35. The lower portion 48 of the spoil guard 44 is preferably of a heavy but flexible material and extends downwardly to engage the bottom wall 36 of the bucket 35. The attachment of the spoil guard 44 to the side walls 18 of the housing 14 is preferably by use of adjustable arms 50 to which the spoil guard 44 is pivotally attached with the arms 50 turn pivotally mounted on the side walls 18 of the housing 14. To provide for adjustability of the spoil guard 44, the arms are moveable by an operating knob 52 which positions the spoil guard 44 relative to the rotating brush 16. This permits the spoil guard 44 to be moved inwardly as the bristles on the brush 16 wear so as to be closer to the brush 16 as illustrated in FIG. 4.

To provide for dumping of the debris contained in the bucket 35, chains 54 or other suitable flexible supports are attached to the rear of the top wall 22 of the sweeper unit 12. The chains are then attached to the lift arms of the skid loader and the length of the chains 54 adjusted until the sweeper unit 12 is allowed to rest on the front pivot wheel 56 with the sweeper unit 12 level with respect to the ground. The chains 54 allow the sweeper unit 12 to remain level when the bucket 35 is raised and pivoted downwardly to dump the spoil material contained in it.

Although the operation of the bucket sweeper unit of the invention should be obvious from the foregoing description, its use and operation is summarized as follows. With the unit attached to the skid loader or other suitable prime mover, the unit is moved to the area to be swept. The unit is lowered until the pivot wheel 56 engages the ground and the sweeper unit 12 is substantially level to the ground. The bucket 35 is then rolled downwardly until the cutting edge 42 is approximately one inch away from engage the ground. During normal operation, contacting the ground with the cutting edge 42 is not necessary and does not improve the effectiveness of the sweeping operation. The rotating brush 16 is then adjusted until the bristles of the rotating brush 16 create a 2" to 3" strike path on the ground. The rotating brush is driven in the direction that allows the debris to be moved forwardly ahead of the sweeping unit and up within the housing 14 and then rearwardly across the deflecting plate 46 of the spoil guard 44. The proper direction of rotation of the rotating brush 16 during typical operation is clockwise as the unit is illustrated in the drawings. When in operation, the debris being picked up from the ground will follow the rotating brush inside of the housing, over the top of the rotating brush, and against the curved wall 20 of the housing 14 from where it will be ejected into the front of the bucket 35. The smaller particles being picked up that would typically follow the rotating brush 16 around back down to the ground will strike the spoil guard 44 and be drawn away from the rotating brush 16 into the bucket 35. If the operator should encounter material that cannot be picked up by the rotating brush 16, the bucket cutting edge 44 can be lowered to engage the ground and scrape the material off the floor after which the unit can be backed up and the area re-swept. Typically, at the end of a sweeping pass, the bucket edge 42 is dropped to engage the ground and the direction of rotation of the brush 16 is reversed. The entire unit is moved slowly forwardly to sweep any small remaining debris back into the bucket. The spoil guard 44 is positioned so as to allow the small amount of debris to be collected on its forward side just behind the cutting edge 42.

As thus described, the adjustable (or non-adjustable) spoil guard that forms a part of the novel combination of the invention is located on the bucket side of the rotating broom so as to deflect the picked up particles away from the rotating broom, thus increasing the effective volume capacity of the bucket. The design of the invention also prevents gathered material, debris, dust, or fines (particles) from being prematurely ejected or removed from the gathering bucket due to the air movement generated by or direct contact with the rotating brush. Air movement in prior art units are a factor in blowing previously captured fines out of the bucket. The bucket sweeper of the invention utilizing the spoil guard so as to affect the internal air movement generated by the rotating brush helps to contain these small fines and eject them into the bucket.

It will be understood by those skilled in the art that the invention is described in connection with a specific configuration that is typically used in the industry, which configuration comprises the preferred embodiment of the invention. However, having thus described the invention in connection with the preferred embodiment thereof, it will be evident to those skilled in the art that various revisions can be made to the preferred embodiment described herein without departing from the spirit and scope of the invention. It is my intention, however, that all such revisions and modifications that are evident to those skilled in the art will be included within the scope of the following claims.

What is claimed is:

1. A bucket sweeper combination unit for use in connection with a prime mover for picking up debris, the prime mover having universal mounts and remote hydraulics that power the unit, said unit comprising:

support beams adapted for attaching the unit to the prime mover;

a sweeper having a housing enclosing a rotatable brush supported by the support beams; the housing having side walls, a front wall and a top wall with the brush mounted for rotation about a substantially horizontal axis extending between the side walls;

a bucket supported by the support beams adjacent the sweeper and mounted for pivotal movement from a closed position to a dump position; the bucket having a bottom wall, side walls and a back wall that define an open front for receipt of debris picked up by the rotating brush; and a spoil guard mounted between the rotating brush and the open front of the bucket to direct debris ejected from the brush into the bucket when in its closed position and to retain the debris in the bucket until the bucket is moved to its dump position, the spoil guard having a deflecting plate extending along its top edge, the remaining portion of the spoil guard being flexible and extending downwardly.

2. The bucket sweeper combination unit of claim 1 in which there is a cutting edge along the bottom edge of the bucket, and the flexible portion of the spoil guard engages the cutting edge when the bucket is in its closed position.

3. The bucket sweeper combination unit of claim 2 in which the spoil guard is adjustably mounted so that its position can be moved closer to the rotating-brush as the brush wears.

4. The bucket sweeper combination unit of claim 3 in which a support arm is combined with a side wall of the housing enclosing the sweeper and the spoil guard is pivotally mounted on the support arm, the support arm being adjustably moveable to position the spoil guard closer to the brush as the brush wears.

5. A bucket sweeper combination unit for use in connection with a prime mover for picking up debris from the ground, the prime mover having universal mounts and remote hydraulics that power the unit, said bucket sweeper combination unit comprising:

support beams adapted for attaching the unit to the prime mover;

a sweeper having a housing enclosing a rotatable brush supported by the support beams, the housing having side walls, a front wall and a top wall that define a discharge opening at the rear;

the brush being mounted within the housing for rotation about a substantially horizontal axis extending between the side walls, and the brush being rotatable in a direction to pick up debris from the ground and carry the debris within the housing forwardly and along the top wall and then downwardly for discharge through the discharge opening;

a bucket pivotally supported by the support beams and having a bottom wall, side walls and a back wall that define a bucket open front;

the bucket being mounted rearwardly of the sweeper with the open front adjacent the housing discharge opening to receive debris from the rotating brush as the brush moves the debris downwardly from the housing top wall;

the pivotal support of the bucket providing for pivotal movement of the bucket from a closed position for receiving the debris to a dump position for discharging the debris; and a spoil guard combined with the housing and extending across part of the discharge opening of the housing and extending downwardly to the ground to direct debris from the rotating brush into the bucket as the debris is carried downwardly from the top wall of the housing, the spoil guard also serving to retain the debris in the bucket until the bucket is moved to its dump position to discharge the debris.

6. The bucket sweeper combination unit of claim 5 in which the spoil guard has a deflecting plate extending along its top edge between the side walls of the housing, the remaining portion of the spoil guard being flexible and extending downwardly to the ground.

7. The bucket sweeper combination unit of claim 6 in which there is a cutting edge along the front, bottom edge of the bucket, and the flexible portion of the spoil guard engages the cutting edge when the bucket is in its closed position.

8. The bucket sweeper combination unit of claim 7 in which the spoil guard is adjustably mounted so that its position can be moved closer to the rotating brush as the brush wears.

9. The bucket sweeper combination unit of claim 8 in which a support arm is combined with a side wall of the housing enclosing the sweeper and the spoil guard is pivotally mounted on the support arm, the support arm being adjustably moveable to position the spoil guard closer to the brush as the brush wears.

* * * * *